US009222146B2

(12) United States Patent
Sato et al.

(10) Patent No.: US 9,222,146 B2
(45) Date of Patent: Dec. 29, 2015

(54) APPARATUS FOR MANUFACTURING MOLTEN ZINC COATED STEEL SHEET

(75) Inventors: Nobuyuki Sato, Tokyo (JP); Takahiro Sugano, Tokyo (JP); Hiroki Yamagami, Tokyo (JP); Takayuki Fukui, Tokyo (JP)

(73) Assignee: JFE Steel Corporation (JP)

( * ) Notice: Subject to any disclaimer, the term of this patent is extended or adjusted under 35 U.S.C. 154(b) by 629 days.

(21) Appl. No.: 12/738,647

(22) PCT Filed: Oct. 30, 2008

(86) PCT No.: PCT/JP2008/070246

§ 371 (c)(1),
(2), (4) Date: Apr. 19, 2010

(87) PCT Pub. No.: WO2009/057819

PCT Pub. Date: May 7, 2009

(65) Prior Publication Data

US 2010/0212590 A1 Aug. 26, 2010

(30) Foreign Application Priority Data

Oct. 31, 2007 (JP) ..... 2007-282805

(51) Int. Cl.

| | |
|---|---|
| ***B05C 11/02*** | (2006.01) |
| ***B05C 11/00*** | (2006.01) |
| ***C21D 9/56*** | (2006.01) |
| ***C23C 18/16*** | (2006.01) |
| ***B05C 11/10*** | (2006.01) |
| ***C23C 2/00*** | (2006.01) |
| ***C23C 2/06*** | (2006.01) |
| ***C23C 2/26*** | (2006.01) |
| ***C23C 2/40*** | (2006.01) |

(Continued)

(52) U.S. Cl.

CPC ..... *C21D 9/561* (2013.01); *B05C 11/1015* (2013.01); *C23C 2/003* (2013.01); *C23C 2/06* (2013.01); *C23C 2/26* (2013.01); *C23C 2/40* (2013.01); *C23C 18/1696* (2013.01); *B05B 15/00* (2013.01); *B05C 3/125* (2013.01)

(58) Field of Classification Search

CPC ..... B05C 11/1005; B05C 11/1015; C23C 18/1682; C23C 18/1696; C23C 2/06; C23C 2/26; C23C 3/02

USPC ..... 118/101, 712, 423; 427/431, 433, 427/434.3, 210; 148/533

See application file for complete search history.

(56) References Cited

U.S. PATENT DOCUMENTS 2,656,284 A * 10/1953 Toulmin, Jr. ..... 427/251
3,857,362 A * 12/1974 Brooks ..... 118/59

(Continued)

FOREIGN PATENT DOCUMENTS

JP 1 108358 4/1989
JP 2 190460 7/1990

(Continued)

*Primary Examiner* — Karl Kurple
(74) *Attorney, Agent, or Firm* — DLA Piper LLP (US)

(57) ABSTRACT

An apparatus for manufacturing a molten zinc coated steel sheet includes a molten zinc coating device, a temper rolling mill, an acid solution contacting device, and a cleaning device connected in tandem, wherein the acid solution contacting device and the cleaning device are separated from each other with a region therebetween and an absolute humidity controller is disposed in the region between the acid solution contacting device and the cleaning device.

2 Claims, 4 Drawing Sheets

(51) Int. Cl.

| | |
|---|---|
| *B05D 1/18* | (2006.01) |
| *B05B 15/00* | (2006.01) |
| *B05C 3/12* | (2006.01) |

(56) References Cited

U.S. PATENT DOCUMENTS

| | | | | |
|---|---|---|---|---|
| 6,010,572 | A * | 1/2000 | Furusawa et al. | 118/408 |
| 6,428,851 | B1 * | 8/2002 | Friedersdorf et al. | 427/318 |
| 6,555,178 | B2 * | 4/2003 | Harakawa et al. | 427/443.1 |
| 7,238,430 | B2 * | 7/2007 | McDevitt et al. | 428/653 |
| 7,617,583 | B2 * | 11/2009 | Takahashi et al. | 29/458 |
| 2001/0041267 | A1 * | 11/2001 | Harakawa et al. | 428/680 |
| 2002/0058154 | A1 * | 5/2002 | Friedersdorf et al. | 428/659 |
| 2002/0114884 | A1 * | 8/2002 | Friedersdorf et al. | 427/195 |
| 2005/0098112 | A1 * | 5/2005 | Arii et al. | 118/715 |
| 2006/0141166 | A1 * | 6/2006 | Brisberger et al. | 427/434.6 |
| 2009/0031950 | A1 * | 2/2009 | Deka et al. | 118/429 |
| 2015/0090182 | A1 * | 4/2015 | Sato | C23C 2/06 118/712 |

FOREIGN PATENT DOCUMENTS

| | | | | |
|---|---|---|---|---|
| JP | 06-081166 | A | 3/1994 | |
| JP | 406081166 | * | 3/1994 | C23C 22/78 |
| JP | 2003-306781 | A | 10/2003 | |
| JP | 3608519 | B2 | 1/2005 | |
| JP | 2002-256448 | * | 12/2005 | C23C 22/53 |
| JP | 2007 010267 | | 1/2007 | |
| JP | 2007016267 | * | 1/2007 | C23C 2/06 |
| JP | 2007 023347 | | 2/2007 | |
| JP | 2007023347 | * | 2/2007 | C23C 2/06 |

* cited by examiner

APPARATUS FOR MANUFACTURING MOLTEN ZINC COATED STEEL SHEET

RELATED APPLICATIONS

This is a §371 of International Application No. PCT/JP2008/070246, with an international filing date of Oct. 30, 2008 (WO 2009/057819 A1, published May 7, 2009), which is based on Japanese Patent Application No. 207-282805, filed Oct. 31, 2007, the subject matter of which is incorporated by reference.

TECHNICAL FIELD

This disclosure relates to an apparatus for stably manufacturing molten zinc coated steel sheets.

BACKGROUND

Molten zinc coated steel sheets are used in various fields, mainly for automobile body applications because they exhibit excellent weldability and paintability. Molten zinc coated steel sheets are used for such applications after being press formed. However, molten zinc coated steel sheets have a drawback. They are inferior to cold-rolled steel sheets in terms of press formability. This is because molten coated steel sheets have larger sliding resistance against press dies than cold-rolled steel sheets. That is, molten zinc coated steel sheets do not easily enter press dies at bead portions having high sliding resistance against the dies, causing rupture of the steel sheets.

For example, an alloyed molten zinc coated steel sheet is manufactured by coating a steel sheet with zinc, and subsequently heating the steel sheet to diffuse Fe in the steel sheet and Zn in the coated layer to each other to effect an alloying reaction, thereby forming an Fe—Zn alloy phase. The Fe—Zn alloy phase is generally a film constituted by a $\Gamma$ phase, a $\delta_1$ phase, and a $\zeta$ phase. As the Fe concentration in the film decreases, that is, in the order of the $\Gamma$ phase, the $\delta_1$ phase, and the $\zeta$ phase, the hardness and the melting point tend to decrease. In view of slidability, the film preferably has a high Fe concentration, which provides high hardness, a high melting point, and less probability of causing adhesion. Thus, alloyed molten zinc coated steel sheets that are intended to have high press formability are manufactured to have high average Fe concentrations in their films.

However, films with high Fe concentrations tend to have a $\Gamma$ phase, which is hard and brittle, at the interfaces between coated layers and steel sheets. This tends to cause a phenomenon called "powdering" that the films come off from the interfaces while the steel sheets are processed, which has been a problem.

In view of those problems, we performed thorough studies which resulted in the findings disclosed in Japanese Unexamined Patent Application Publication No. 2003-306781. A flat portion on a surface of an alloyed molten zinc coated steel sheet protrudes from the surrounding areas. The flat portion is specifically brought into contact with a press die when the steel sheet is press formed. Hence, reduction of sliding resistance of the flat portion provides improved press formability. The sliding resistance of the flat portion is reduced by preventing adhesion of the coated layer to a die. This is achieved by forming a hard film with a high melting point on the surface of the coated layer.

We thus performed additional studies and found that control of the thickness of an oxide film on the surface layer of the flat portion is effective, and such control of the thickness of an oxide film on the surface layer of the flat portion prevents adhesion of the coated layer to a die and provides good slidability. We further found that such an oxide film is effectively formed by a method of bringing a coated surface layer into contact with an acid solution to form a Zn-based oxide layer thereon.

We then discovered a technique of bringing an alloyed molten zinc coated steel sheet into contact with an acid solution to form an oxide mainly containing Zn (hereinafter, referred to as a "Zn-based oxide") on a surface of the steel sheet, thereby suppressing adhesion of the coated layer to a press die and enhancing slidability. That technique, disclosed in Japanese Patent No. 3608519 is directed to a method for manufacturing a steel sheet in which water vapor with a temperature of 100° C. or more is sprayed on a steel sheet to which an acid treatment solution has been applied. The method was intended to form an oxide film on a surface of the steel sheet in a short time with reliability.

However, in that method, it is difficult to spray water vapor evenly over a surface of a steel sheet. Hence, water vapor is actually sprayed unevenly over a surface of a steel sheet. This generates unevenness on the surface of the steel sheet and degrades the appearance of the surface.

It could therefore be helpful to provide an apparatus for manufacturing a molten zinc coated steel sheet, the apparatus being capable of stably forming a necessary oxide film without degrading the appearance of the surface of a steel sheet, the apparatus being easily put into practical use.

SUMMARY

We thus provide:

[1] An apparatus for manufacturing a molten zinc coated steel sheet including: a molten zinc coating device, a temper rolling mill, an acid solution contacting device, and a cleaning device connected in tandem, wherein the acid solution contacting device and the cleaning device are separated from each other with a region therebetween and an absolute humidity controller is disposed in the region between the acid solution contacting device and the cleaning device.

[2] An apparatus for manufacturing a molten zinc coated steel sheet including: a molten zinc coating device, a galvannealing furnace, a cooling device, a temper rolling mill, an acid solution contacting device, and a cleaning device connected in tandem, wherein the acid solution contacting device and the cleaning device are separated from each other with a region therebetween and an absolute humidity controller is disposed in the region between the acid solution contacting device and the cleaning device.

[3] The apparatus for manufacturing a molten zinc coated steel sheet according to [1] or [2], wherein the absolute humidity controller includes a cover that covers an upper surface, a lower surface, and two side surfaces of a steel sheet and through which the steel sheet can be passed; a blower that blows water vapor or dry air into the cover; and a measuring device that measures temperature and relative humidity, or a dew point.

DETAILED DESCRIPTION

Figure 1:
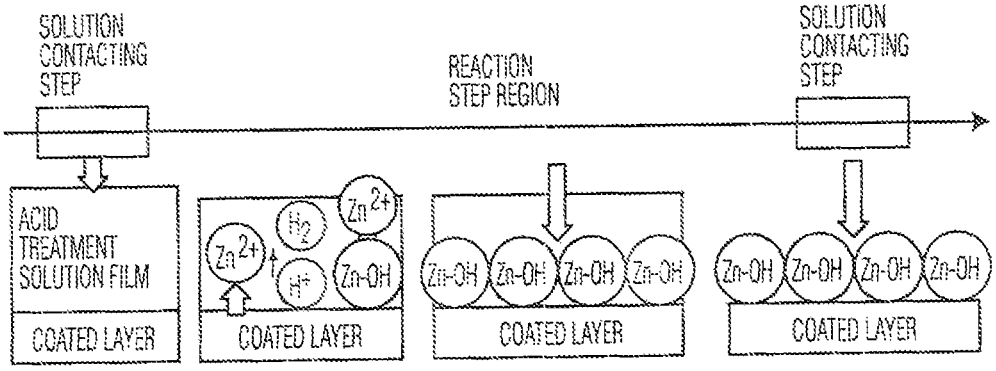
FIG. 1 is a schematic view showing a method for manufacturing a molten zinc coated steel sheet.

A molten zinc coated steel sheet refers to a molten zinc coated steel sheet not subjected to an alloying treatment, and a galvannealed steel sheet subjected to an alloying treatment after having been subjected to a coating treatment.

We provide an improved apparatus for manufacturing an alloyed molten zinc coated steel sheet in which a steel sheet that is coated with molten zinc, subsequently optionally heated to be alloyed, and subjected to temper rolling is brought into contact with an acid solution, left for 1 to 120 seconds after the contact is complete and, subsequently cleaned with water, thereby forming a 10 nm or more Zn-based oxide layer, that is, an oxide film, on a surface of the molten zinc coated steel sheet.

Specifically, an apparatus for manufacturing a molten zinc coated steel sheet includes a molten zinc coating device, a temper rolling mill, an acid solution contacting device, and a cleaning device connected in tandem. The acid solution contacting device and the cleaning device are separated from each other with a region therebetween. In the case where an alloyed molten zinc coated steel sheet is manufactured, a galvannealing furnace and a cooling device are provided in the region between the molten zinc coating device and the temper rolling mill.

Means for controlling absolute humidity is provided in the region between the acid solution contacting device and the cleaning device. The absolute humidity is controlled by, for example, blowing moisture-containing air by automatically or manually opening or closing a valve or adjusting the degree of opening of a flow rate control valve; arbitrarily changing the number of blowout openings; or arbitrarily changing the amount of moisture in blown air with a hygroscopic material, steam, or the like. The means for controlling absolute humidity preferably includes a cover that covers an upper surface, a lower surface, and two side surfaces of a steel sheet and through which the steel sheet can be passed; blowing means for blowing water vapor or dry air into the cover in a direction parallel to the traveling direction of the steel sheet, (for example, a method of providing one or more spray nozzles or a pipe that is properly perforated or a method of directly providing a nozzle header or a blowout opening); and measuring means for measuring temperature and relative humidity, or a dew point, (for example, the measuring means being a thermometer and a hygrometer, a dew-point hygrometer, a unit that measures a dew point or absolute humidity based on temperature and humidity, or the like). As described above, a feature, a core point, of the apparatus is that means for controlling absolute humidity is disposed in the region between the acid solution contacting device and the cleaning device and, preferably, a cover, blowing means, and measuring means are disposed in this region.

In a region after a steel sheet is brought into contact with an acid solution and until the steel sheet is cleaned (hereinafter, referred to as a "reaction step region"), a Zn-based oxide is generated on a coated surface of the steel sheet and an oxide film is formed on the coated surface of the steel sheet. Disposition of means for controlling absolute humidity in the region between the acid solution contacting device and the cleaning device, which corresponds to the reaction step region, enables stable formation of an oxide film on a coated surface of a steel sheet. Disposition of the cover, the blowing means, and the measuring means enables more accurate control of the atmosphere in the reaction step region. As a result, an oxide film with more stability can be obtained.

Turning now to the drawings, FIG. 1 schematically shows a method for manufacturing a molten zinc coated steel sheet in which an acid solution is applied to a surface of a molten zinc coated steel sheet and the steel sheet is left for a period of time to form an oxide film thereon. In FIG. 1, the region formed between an acid solution contacting step and a cleaning step is a reaction step region where an oxide film is formed. In the reaction step region, it is important that an oxide film is formed with stability on a coated surface.

Figure 2:
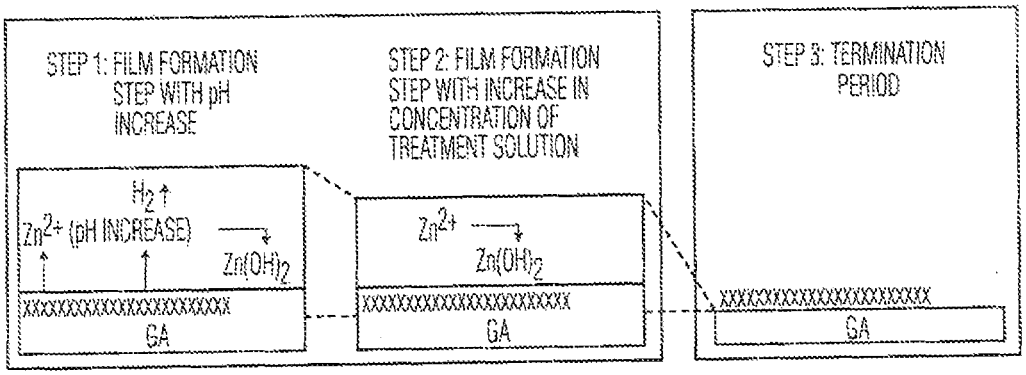
FIG. 2 is a view showing a mechanism of formation of an oxide film.

FIG. 2 shows a mechanism of formation of an oxide film. As shown in FIG. 2, the pH of a solution film increases as the reaction proceeds while the amount of the solution film is sufficient. As the amount of the solution film decreases, the concentration of zinc ions increases, which promotes the reaction. When the solution film is dried completely, no oxidation reaction occurs.

Figure 3:
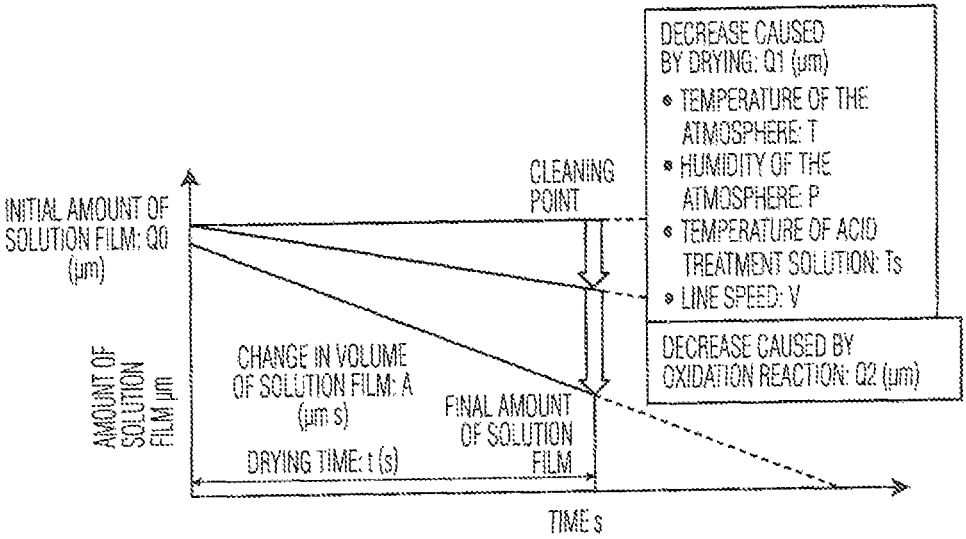
FIG. 3 is a schematic view in which influence factors on a change in the amount of a solution film are summarized.

FIG. 3 is a schematic view in which influence factors on a change in the amount of a solution film are summarized. As shown in FIG. 3, the change in the amount of the solution film is divided into a decrease Q1 caused by drying and a decrease Q2 caused by the oxidation reaction. In particular, the decrease Q1 caused by drying increases with decreases in temperature and humidity of the atmosphere in the reaction step, an increase in the temperature of an acid treatment solution, or an increase in line speed. As can be seen from FIG. 3, the amount of oxide film generated is thought to be in correlation with the change in volume of a solution film. The correlation is presumably represented by the following relation:

$$\text{Thickness of Oxide Film}=F(T\cdot P\cdot T_S\cdot V\cdot Q2)$$

T: temperature of the atmosphere

P: humidity of the atmosphere $T_S$: temperature of an acid treatment solution

V: line speed

Q2: a decrease caused by the oxidation reaction.

If atmosphere temperature T and atmosphere humidity P in the relation can be controlled, the decrease Q1 in the solution film can be decreased, thereby stabilizing the amount of the oxide film.

We found that an oxide film with stability can be obtained by controlling humidity so that generation of an oxide film is not inhibited by drying of an acid solution on the surface layer in the reaction step region. This is achieved, for example, by disposing a humidifier that can control the amount of vapor (dew point) in the atmosphere in the reaction step region. That is, on the basis of the results of the studies, means for controlling absolute humidity is disposed in the region between the acid solution contacting device and the cleaning device, the region corresponding to the reaction step region. The absolute humidity refers to the moisture content in the air and is represented by the product of saturated vapor pressure and relative humidity.

Figure 4:
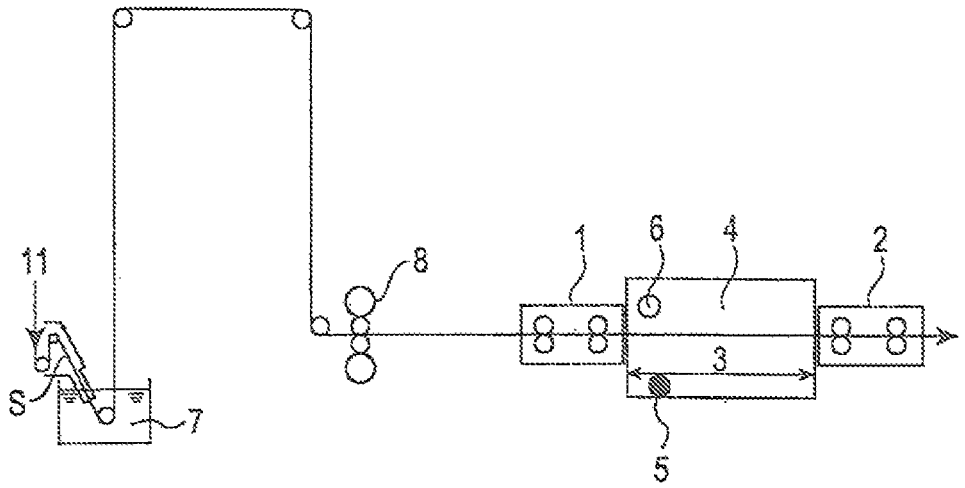
FIG. 4 is a view showing an apparatus for manufacturing a molten zinc coated steel sheet.

FIG. 4 shows an example of our apparatus. In FIG. 4, there are connected in tandem a molten zinc coating device 7 that subjects the surfaces of a steel sheet to a coating treatment; a temper rolling mill 8 that adjusts the roughness of the coated surfaces; an acid solution contacting device 1 that applies an acid solution to the steel sheet that has been subjected to the coating treatment for the surfaces and subsequently the temper rolling; and a cleaning device 2 that cleans off an excess of the acid solution from the coated surfaces after oxide films have been formed thereon. The acid solution contacting device 1 and the cleaning device 2 are separated from each other with a region therebetween. In FIG. 4, means for controlling absolute humidity is further provided in a region 3 between the acid solution contacting device 1 and the cleaning device 2. The means for controlling absolute humidity includes a cover 4 that covers an upper surface, a lower surface, and two side surfaces of a steel sheet and through which the steel sheet can be passed; blowing means 5 for blowing water vapor into the cover; and measuring means 6 for measuring temperature and relative humidity, or a dew point.

Hereinafter, an example of a method for forming an oxide film on a coated surface with the apparatus shown in FIG. 4 is described.

Molten Zinc Coating Treatment

A molten zinc coated steel sheet is generally manufactured by annealing a steel sheet S in a continuous annealing furnace 11, which is provided prior to a molten zinc coating device, and by coating the steel sheet S with a molten zinc coating device 7.

The molten zinc coating device 7, for example, continuously guides the steel sheet S into a zinc coating bath, the steel sheet S having been heated near the temperature of the zinc coating bath; withdraws the steel sheet S from the coating bath; and subsequently controls the amount of coating adhering to the steel sheet S in the range from 20 to 120 g/m$^2$ by gas wiping. When an alloyed molten zinc coated steel sheet is manufactured, the steel sheet that has been coated with molten zinc in this way is guided into a galvannealing furnace and processed into an alloyed molten zinc coated steel sheet containing about 6 to 15 mass % Fe in the coated layers as a result of thermal diffusion. In this case, although any heating mode may be used as long as the steel sheet can be heated to a predetermined temperature and a predetermined amount of Fe can be diffused into the coated layers, a furnace for performing high frequency induction heating is preferably used. This is because a steel sheet can be heated instantaneously by high frequency induction heating, whereby uniform alloying can be achieved in a short time and only a little variation in terms of alloying occurs in the transverse and longitudinal directions of a steel sheet.

Since the steel sheet S that has been coated with molten zinc and alloyed in the above-described manner has a high temperature, the steel sheet S is preferably cooled to about room temperature with a cooling device using an air blower or the like.

Temper Rolling

After that, to control properties of the material and adjust the roughness of the coated surfaces, the coated steel sheet S is guided to the temper rolling mill 8. During the temper rolling, irregularities of the coating are planarized and flat portions are formed on the coated surfaces. This planarization of the irregularities enhances slidability of the molten zinc coated steel sheet. Hence, it is critical to provide such flat portions on the coated surfaces. In contrast, portions (recesses) that are not planarized are also important because the recesses hold lubricating oil and prevent a situation in which there is a lack of oil when the steel sheet is subjected to press forming. In view of this, the area of the flat portions is preferably 20% to 80% over the area of the coated surfaces. A reduction ratio during the temper rolling is preferably adjusted to achieve the area ratio of the flat portions.

Acid Solution Treatment

The temper-rolled coated steel sheet S is subsequently guided to the acid solution contacting device 1, where the steel sheet S is subjected to a treatment for forming a Zn-based oxide on the flat portions of the coated surfaces. The Zn-based oxide is generated presumably because bringing the coated steel sheet S into contact with an acid solution causes Zn, which is the component of the coating, to dissolve in the solution and a hydrogen generating reaction involved in the dissolution increases the pH of the solution, and hence, a hydroxide of Zn precipitates on the coated surfaces. However, bringing the coated steel sheet S into contact with an acid solution only causes Zn to dissolve in the solution and the Zn-based oxide is not generated. To generate the Zn-based oxide, the coated steel sheet S needs to be left for a certain period of time after being brought into contact with an acid solution. For this reason, we define the region 3 between the acid solution contacting device 1 and the cleaning device 2 as a reaction step region and the steel sheet S is left in the region 3 for a certain period of time.

Any device that brings the coated steel sheet S and an acid solution into contact with each other is usable as the acid solution contacting device 1. Examples thereof include a device for immersing the steel sheet S into an acid solution, a device for spraying an acid solution, and a device for applying an acid solution to the steel sheet S with a roller. Ultimately, an acid solution preferably forms a thin solution film on a surface of the steel sheet. This is because the presence of an acid solution in a large amount on a surface of the steel sheet prevents a pH increase of the solution, which is supposed to be caused by dissolution of zinc. In this case, zinc continuously dissolves without increasing the pH of the solution. Hence, it takes a long period of time until an oxide layer is formed. This also results in severe damage of the coated layer and the steel sheet may no longer exhibit corrosion prevention properties. In view of this, the adhesion amount of an acid solution film to be formed on a surface of a steel sheet is preferably adjusted to 50 g/m$^2$ or less. The amount of the solution film can be adjusted with a squeezing roller or by air wiping, or the like.

An acid solution to be used is required to dissolve Zn in the coated layer. Hence, the acid solution needs to be controlled to a pH of about 1.0 to 4.0. Any solution having a pH in this range may be used. Hydrochloric acid, sulfuric acid, nitric acid, or the like may be used. Alternatively, a solution containing a compound such as a chloride, a sulfate, or a nitrate may also be used.

An acid solution preferably has a temperature in the range of 20° C. to 70° C. Use of an acid solution at a temperature of less than 20° C. takes a long period of time for effecting reaction of generating an oxide layer, which can decrease productivity. In contrast, use of an acid solution at a high temperature causes the reaction to proceed at a relatively high rate. However, the treatment tends to result in an uneven surface of the steel sheet.

Oxide Film Formation Treatment

After the coated steel sheet S is brought into contact with an acid solution, an oxide film is formed by leaving the molten zinc coated steel sheet for a period of time in the region 3 between the acid solution contacting device 1 and the cleaning device 2. To achieve this, as described above, means for controlling absolute humidity is provided in the region 3.

Referring to FIG. 4, the cover 4, the blowing means 5, and the measuring means 6 are provided as the means for controlling absolute humidity, whereby the atmosphere of the reaction step region for forming a Zn-based oxide can be controlled.

The measuring means 6 is configured to measure temperature and relative humidity, or a dew point at regular intervals or all the time. The amount of water vapor in the reaction step region (in the cover) is adjusted, on the basis of the result provided by the measuring means 6, by blowing water vapor into the cover 4 with the blowing means 5 so that an oxide film is formed with more stability. As a result, an oxide film can be formed more stably. Water vapor is not required to directly touch the steel sheet and is preferably blown in a direction substantially parallel to the traveling direction of the steel sheet.

As described above, the means for controlling absolute humidity functions to adjust absolute humidity in accordance with the atmosphere of the reaction step region so that the reaction of forming an oxide film proceeds with stability and reliability. For example, the means for controlling absolute humidity is a unit having a humidifying function or a unit having a dehumidifying function. The means for controlling absolute humidity controls absolute humidity by, for example, measuring temperature and relative humidity, or a dew point to provide a result and humidifying or dehumidifying in accordance with the result.

The size, material, and so on of the cover 4 are not particularly restricted as long as the cover 4 covers an upper surface, a lower surface, and two side surfaces of a steel sheet and through which the steel sheet can be passed as described above. Also, the shape of the cross section of the cover 4 in the traveling direction of a steel sheet is not particularly restricted. For example, the shape may be circular or rectangular. The cover 4 is preferably disposed, for example, in the case of using a unit having a humidifying function, at a place that seems to dry most within the region 3 between the acid solution contacting device and the cleaning device. Although the drying state depends on temperature, relative humidity, and passage speed of a steel sheet in the reaction step, such a place is within 14 m from the rear end of the acid treatment solution contacting device 1 when the reaction step is conducted under normal operating conditions. Thus, the humidifying unit is preferably disposed in this place.

The blowing means 5 is configured to blow water vapor or dry air into the cover 4. For example, steam pipes may be disposed at regular intervals in the traveling direction of a steel sheet, the steam pipes having a plurality of blowout openings. In this case, the lengths of the steam pipes and the number of the blowout openings are properly determined depending on the component length of the cover 4. Water vapor or dry air is preferably blown in a direction substantially parallel to the traveling direction of a steel sheet.

The blowing means 5 can be disposed for either one of the front and back surfaces of a steel sheet or for both of the surfaces of a steel sheet. The blowing means 5 is preferably disposed at a location separated vertically from a surface of a steel sheet by 500 mm or more so that water vapor or the like does not directly touch the steel sheet. The blowing means 5 may be disposed on the bottom surface of the component.

Water vapor or dry air is preferably blown in a direction substantially parallel to the traveling direction of a steel sheet. Water vapor is preferably blown from a nozzle at a vapor pressure of 0.5 kgf/cm$^2$ or less, which is a condition under which water vapor is expected to be fully dispersed in the cover 4. Water vapor blown under this condition is fully dispersed in the cover 4.

The measuring means 6 is configured to measure temperature and relative humidity, or a dew point. Specifically, the measuring means 6 is a thermometer and a hygrometer, or a dew-point hygrometer. The measuring means 6 is preferably disposed at a location within 500 mm in the vertical direction from a surface of a steel sheet. The measuring means 6 is also preferably disposed at a location separated from the blowout openings by 1 m or more so that the measuring means 6 is not affected by water vapor or dry air. Furthermore, the measuring means is preferably disposed on the side opposite to the blowout openings.

As described above, an oxide film is formed with stability on a coated surface by controlling absolute humidity. The absolute humidity refers to the moisture content in the air, the moisture content being the product of saturated vapor pressure and relative humidity.

Figure 5:
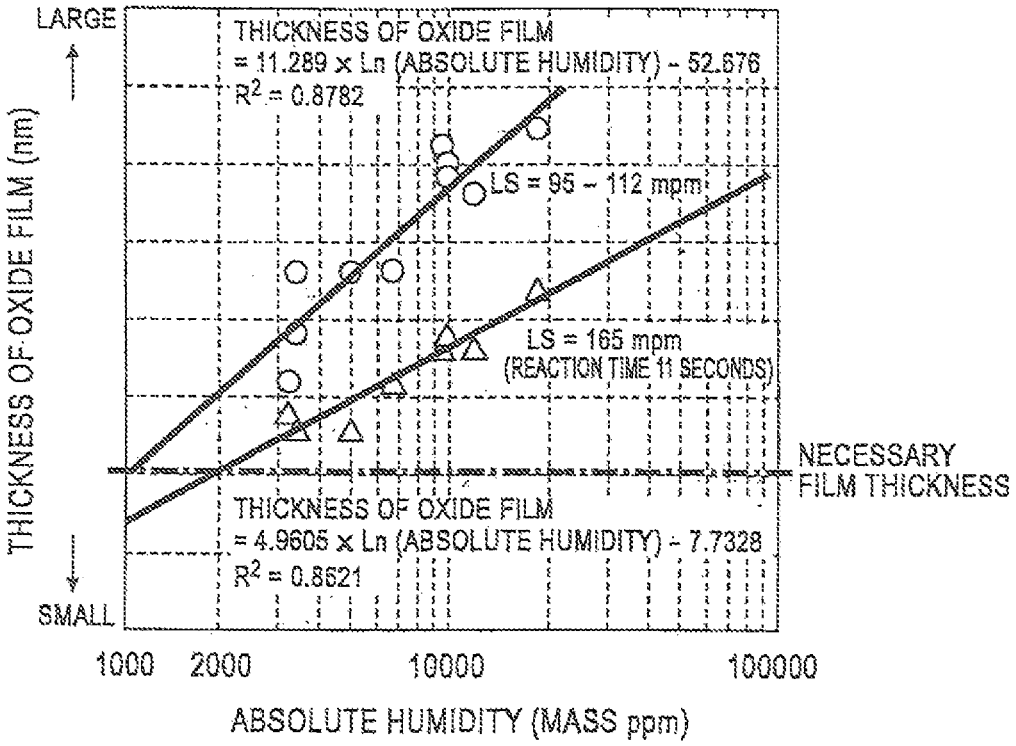
FIG. 5 is a graph showing the relationship between absolute humidity and thickness of an oxide film.

FIG. 5 shows that the thickness of an oxide film increases as the absolute humidity increases. FIG. 5 shows that the film thickness is affected by line speed (reaction time) at the same absolute humidity. In view of line speed, for example, an absolute humidity of 2000 ppm by mass or more is required to obtain a necessary film thickness. Thus, to prevent drying of an acid solution on a surface layer of a steel sheet and to obtain an oxide film with a necessary film thickness or more, the amount of water vapor is maintained at 2000 ppm by mass or more (a dew point of −12.7° C. or more) with the cover 4, the blowing means 5, and the measuring means 6 shown in FIG. 4. Too high an absolute humidity results in too large a thickness of an oxide film, adversely affecting paintability. Thus, the upper limit of absolute humidity may be determined in accordance with required paintability.

Cleaning Treatment

A steel sheet that has passed through the reaction step region as described above is subjected to a treatment of cleaning off an acid solution component remaining on a surface of the steel sheet with the cleaning device 2. An insufficient cleaning treatment leaves the acid solution component remaining on the coated surface, whereby the component can promote corrosion of the surface when the steel sheet is processed into a product. For this reason, instead of cleaning the steel sheet with water, guiding the steel sheet to a neutralization treatment device and neutralizing the acid solution component remaining on the coated surface with the device is also useful. A solution used for the neutralization treatment is not particularly restricted as long as the solution is alkaline. An aqueous solution of sodium hydroxide, sodium phosphate, or the like may be used.

A "Zn-based oxide" layer refers to a layer composed of an oxide and/or hydroxide that indispensably contains Zn. Such an oxide layer indispensably containing Zn is required to have an average thickness of 10 nm or more on the surface layer of a temper-rolled portion and on the surface layer of a non-temper-rolled portion. An oxide layer having an average thickness of less than 10 nm on the surface layer of a temper-rolled portion and on the surface layer of a non-temper-rolled portion provides an insufficient effect of decreasing sliding resistance. In contrast, when an oxide layer indispensably containing Zn has an average thickness of more than 100 nm on a temper-rolled portion and a non-temper-rolled portion, there is a tendency that the film is broken in the press forming, sliding resistance increases, and weldability decreases. This is not preferable.

Although manufacturing of a coated steel sheet requires addition of Al to the Zn coating bath, addition elements other than Al are not particularly restricted. That is, in addition to Al, the Zn coating bath may contain Pb, Sb, Si, Sn, Mg, Mn, Ni, Ti, Li, Cu, or the like, which does not impair the steel sheet.

An oxide layer may incorporate S, N, Pb, Cl, Na, Mn, Ca, Mg, Ba, Sr, Si, or the like from a treatment solution that contains impurities and is used for an oxidation treatment. This also does not impair the steel sheet.

In summary, a steel sheet with good slidability can be obtained with stability by subjecting a surface of a temper-rolled coated steel sheet to a treatment of forming a necessary oxide film with reliability with an apparatus for manufacturing a coated steel sheet.

When a high load is applied in press forming, a non-temper-rolled portion as well as a temper-rolled portion of a surface of a steel sheet are expected to be brought into direct contact with a die. For this reason, it is important, for enhancing slidability of a molten zinc coated steel sheet, that a temper-rolled portion and a non-temper-rolled portion of a surface of the steel sheet has a substance that is hard and has a high melting point for preventing adhesion of the steel sheet to a die. In terms of this point, since an oxide layer on a surface of a steel sheet prevents adhesion of the surface to a die, the presence of the oxide layer on a surface of the steel sheet is useful for enhancing the slidability of the steel sheet.

EXAMPLE

Next, our apparatus and steel sheets are described in further detail with respect to a representative EXAMPLE.

Figure 6:
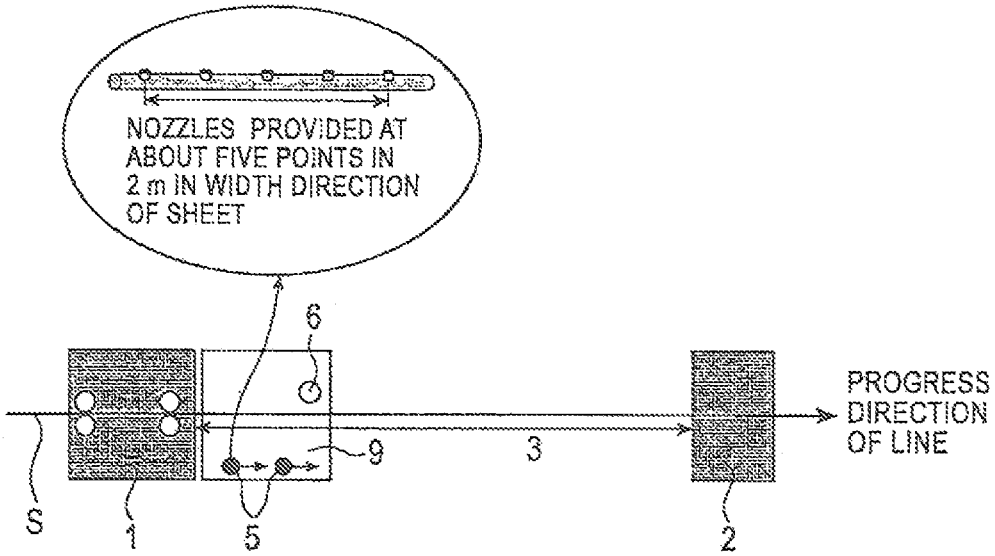
FIG. 6 is a schematic view showing an apparatus for manufacturing another molten zinc coated steel sheet.

FIG. 6 is a schematic view showing an apparatus for manufacturing a molten zinc coated steel sheet. Features common to structures shown in FIGS. 4 and 6 are designated with identical reference numerals to omit detailed descriptions for the features. In FIG. 6, a humidifier 9 for controlling the atmosphere in the reaction step region is disposed in a region 3 between an acid solution contacting device 1 and a cleaning device 2. The humidifier 9 contains blowing means 5 and measuring means 6 for measuring temperature and relative humidity, or a dew point. Hereinafter, the components are described in detail.

Humidifier 9

The location of a place that seems to dry most within the region 3 between the acid solution contacting device 1 and the cleaning device 2 depends on temperature, relative humidity, and passage speed of a steel sheet in the reaction step. However, such a place is located within 14 m from the rear end of the acid solution contacting device 1 when the reaction step is conducted under normal operating conditions. Thus, the humidifier 9 is preferably disposed in this place. As shown in FIG. 6, the humidifier 9 is disposed at a place 1 m away from the rear end of the acid solution contacting device 1. The shape of the cross section of the humidifier 9 in the traveling direction of a steel sheet is rectangular. The humidifier 9 is made of vinyl chloride. The distance between the acid solution contacting device 1 and the cleaning device 2 is 30 m.

The humidifier 9 preferably has a humidifying range of 6 m or more (7 m in FIG. 6). The passage time of a steel sheet through the humidifier 9 is set at 2 seconds.

The blowing means 5 is constituted by two steam pipes disposed at a spacing of 3 m in the traveling direction of a steel sheet. Each of the steam pipes has five nozzles.

The blowing means 5 may be disposed for either one of the front and back surfaces of a steel sheet or for both of the surfaces of a steel sheet. In FIG. 6, the blowing means 5 is disposed on the back surface side of a steel sheet and on the bottom surface of the humidifier 9, which is at a location 500 mm or more vertically away from the under surface of the steel sheet.

Water vapor is blown in a direction substantially parallel to the traveling direction of the steel sheet. Water vapor is blown from the nozzles at a vapor pressure of 0.5 kgf/cm$^2$ or less, which is a condition under which water vapor is expected to be fully dispersed in the humidifier 9.

Dehumidifier 10

When absolute humidity is not controlled and absolute humidity exceeds the upper limit, a dehumidifier 10 is disposed (FIG. 7) instead of the humidifier 9 in FIG. 6. The dehumidifier 10 performs dehumidification by blowing dry air instead of blowing water vapor with the humidifier 9. The absolute humidity of the dry air may be selected depending on desired humidity conditions.

The location, conditions, and the like in terms of nozzles are the same as those of the humidifier 9.

Measuring Means 6

Figure 7:
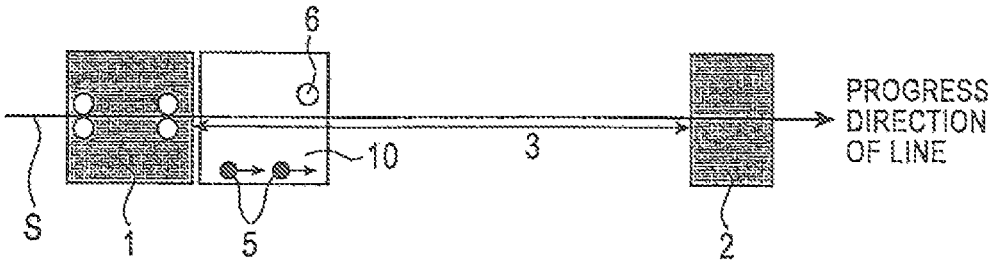
FIG. 7 is a schematic view showing an apparatus for manufacturing still another molten zinc coated steel sheet.
Figure 8:
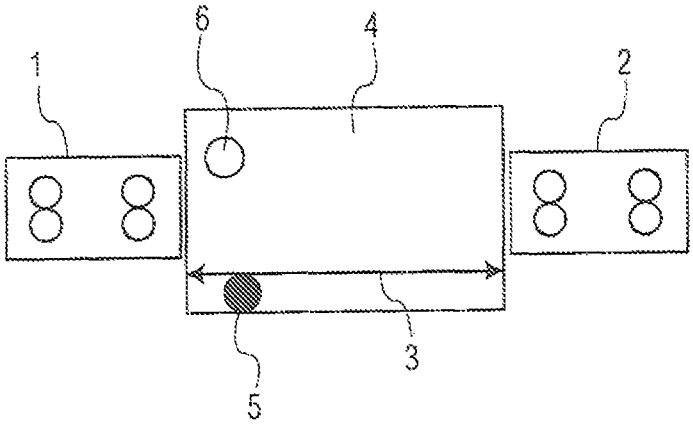
FIG. 8 illustrates the humidity controller disposed in the region between the acid solution contacting device and the cleaning device.

The measuring means 6 is preferably disposed at a location within 500 mm in the vertical direction from a surface of a steel sheet. The measuring means 6 is disposed at a place 300 mm away in the vertical direction from a surface of a steel sheet in FIGS. 6 and 7. The place is also separated from the nozzles by 1 m or more so that the measuring means 6 is not affected by water vapor or dry air. Furthermore, the measuring means is preferably disposed on the side opposite to the nozzles. As shown in FIGS. 6 and 7, the measuring means is disposed at a location near the front surface of the sheet, the location being on the side opposite to the nozzles. As shown in FIG. 6, the measuring means is used to measure a dew point.

Molten zinc coated steel sheets were manufactured with the apparatuses for manufacturing a molten zinc coated steel sheet in FIGS. 6 and 7.

An alloyed molten zinc coated film was formed by standard procedures on a 0.8 mm thick cold-rolled steel sheet. The steel sheet was then temper-rolled. After that, the steel sheet was guided into the acid solution contacting device 1 filled with a sulfuric acid solution having a temperature of 50° C. and a pH of 2.0. The coated steel sheet S that had been immersed in the acid solution was passed through the region 3, thereby being brought into contact with the air for 13 seconds. The steel sheet S was rinsed with the cleaning device 2. Moisture was removed from the steel sheet S with a dryer. Thus, a molten zinc coated steel sheet having oxide films on the coated surfaces was obtained. Ultimately, the steel sheet was coated with simple anticorrosive oil and wound into a coil to provide a product.

The line speed was 100 mpm. The measuring means 6 was used to measure a dew point in the humidifier 9 or the dehumidifier 10 when the coated steel sheet S was passed through the humidifier 9 or the dehumidifier 10. On the basis of the results, the blowing means 5 was used to blow water vapor or dry air so that the dew point in the humidifier 9 or the dehumidifier 10 was −12.7° C. or more and not more than the upper limit of the dew point defined in accordance with the upper limit of the thickness of an oxide film.

The thus-obtained molten zinc coated steel sheet was measured by the following method in terms of the thickness of oxide layers in the temper-rolled portion and the non-temper-rolled portion of the coated surface layer. The measurement results showed that oxide films that sufficiently enhance slidability were formed on the temper-rolled portion and the non-temper-rolled portion.

Measurement of Oxide Film Thickness

The content (at. %) of each element was measured in terms of the temper-rolled portion and the non-temper-rolled portion of the coated surface layer by Auger electron spectroscopy (AES). The coated surface layer was then subjected to Ar sputtering to a certain depth and the content of each element in the coated film was measured by AES. These steps were repeated and the distribution of the elements in the depth direction was measured. The thickness of the oxide was defined as the depth at a position that was deeper than the place where the maximum of O content resulting from oxide and hydroxide was obtained and that had half of the sum of the maximum O content and a predetermined value. The thickness of the oxide was measured at two places in each of the temper-rolled portion and the non-temper-rolled portion. The average values of the resultant thickness were defined as the oxide film thickness of the temper-rolled portion and the non-temper-rolled portion. Note that Ar sputtering was conducted for 30 seconds as a pretreatment to remove a contamination layer on the surface of the sample.

As described above, a necessary oxide film can be formed with reliability on a surface of a coated steel sheet without degrading the appearance of the steel sheet surface with an apparatus of a molten zinc coating. The apparatus is easily put into practical use. For example, the amount of water vapor in the reaction step can be adjusted to 2000 ppm by mass or more without spraying water vapor directly onto a steel sheet.

Alloyed molten zinc coated steel sheets exhibiting excellent slidability upon press forming can be manufactured with stability on an industrial scale with an apparatus for manufacturing a molten zinc coating. Therefore, our apparatus provides great advantages for industrial fields.

INDUSTRIAL APPLICABILITY

A necessary oxide film can be formed with reliability without degrading the appearance of a surface of a steel sheet with an apparatus for manufacturing a molten zinc coated steel sheet. Such an apparatus is applicable to various fields and mainly to automobile body applications.

The invention claimed is:

1. An apparatus for manufacturing a steel sheet with a molten zinc coating comprising:

a galvannealing furnace, a molten zinc coating device, a temper rolling mill, an acid solution contacting device which provides an acid solution film on a surface of the steel sheet, and a cleaning device, said molten zinc coating device, said temper rolling mill, said acid solution contacting device, and said cleaning device are configured to provide treatment to an upper surface and a lower surface of the steel sheet, wherein the acid solution contacting device and the cleaning device are separated from each other with a region therebetween, and an absolute humidity controller is configured to control the thickness of the acid solution film by controlling the absolute humidity in the region between the acid solution contacting device and the cleaning device, wherein said absolute humidity controller is disposed in the region between the acid solution contacting device and cleaning device, said absolute humidity controller includes a cover which encloses the region between the acid solution contacting device and the cleaning device, said absolute humidity controller includes a measuring means, a blower, and encloses the surfaces of the steel sheet as the steel sheet passes through said absolute humidity controller, and wherein the absolute humidity controller maintains the amount of water vapor at 2000 ppm by mass or more and a dew point of at least −12.7° C. in the absolute humidity controller.

2. The apparatus according to claim 1, wherein the temper rolling mill operates on the steel strip after the molten zinc coating device such that flat portions of the steel sheet after coating are 20% to 80% of the surface of the steel sheet.

* * * * *